US010662051B2

(12) United States Patent
Barron

(10) Patent No.: US 10,662,051 B2
(45) Date of Patent: May 26, 2020

(54) CASSETTE HAVING A PRESS ROLLER

(71) Applicant: Robert Bosch GmbH, Stuttgart (DE)

(72) Inventor: Dan Barron, Schaffhausen (CH)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/346,472

(22) PCT Filed: Aug. 30, 2017

(86) PCT No.: PCT/EP2017/071778

§ 371 (c)(1),
(2) Date: Apr. 30, 2019

(87) PCT Pub. No.: WO2018/082826

PCT Pub. Date: May 11, 2018

(65) Prior Publication Data

US 2019/0276295 A1 Sep. 12, 2019

(30) Foreign Application Priority Data

Nov. 4, 2016 (DE) ..... 10 2016 221 605

(51) Int. Cl.

| | |
|---|---|
| ***B67D 1/00*** | (2006.01) |
| ***B30B 9/20*** | (2006.01) |
| ***B65D 35/28*** | (2006.01) |

(52) U.S. Cl.

CPC ..... *B67D 1/0001* (2013.01); *B30B 9/20* (2013.01); *B65D 35/28* (2013.01)

(58) Field of Classification Search

CPC ..... B67D 1/0001; B30B 9/20; B30B 9/205; B30B 9/207; B65D 35/28; B65D 35/285

USPC ..... 222/101, 98, 102, 105, 214

See application file for complete search history.

(56) References Cited

U.S. PATENT DOCUMENTS

| | | | | |
|---|---|---|---|---|
| 2,545,342 | A * | 3/1951 | Choquette | B65D 35/28 222/101 |
| 5,199,610 | A | 4/1993 | Gagliardi | |
| 5,868,282 | A * | 2/1999 | Imhoff | B65D 35/28 222/101 |
| 6,691,894 | B2 * | 2/2004 | Chrisman | B67D 1/0001 222/101 |
| 7,086,428 | B2 * | 8/2006 | Schroeder | B67D 7/0216 141/65 |
| 7,147,134 | B2 | 12/2006 | Gutierrez et al. | |
| 7,603,834 | B2 * | 10/2009 | Schroeder | A23G 9/28 53/393 |

(Continued)

FOREIGN PATENT DOCUMENTS

| | | |
|---|---|---|
| DE | 102005021632 | 11/2006 |
| WO | 9700818 | 1/1997 |
| WO | 2015124374 | 8/2015 |

OTHER PUBLICATIONS

International Search Report for Application No. PCT/EP2017/071778 dated Dec. 15, 2017 (English Translation, 2 pages).

*Primary Examiner* — Lien M Ngo
(74) *Attorney, Agent, or Firm* — Michael Best & Friedrich LLP

(57) ABSTRACT

The invention is characterized in that a cassette (10) of a dosing device (1) is, for the first time, provided with a press roller (30) in order to be able to empty a tubular bag (20), which is held in the cassette (10) in an exchangeable manner, with a smallest possible residual amount.

15 Claims, 4 Drawing Sheets

(56) References Cited

U.S. PATENT DOCUMENTS

| | | | | |
|---|---|---|---|---|
| 10,124,921 | B2 * | 11/2018 | Barron | B65B 69/005 |
| 10,420,355 | B2 * | 9/2019 | Vulpitta | B67D 1/0001 |
| 10,543,652 | B2 * | 1/2020 | Katz | A47J 19/02 |
| 2002/0092879 | A1 | 7/2002 | Chrisman et al. | |
| 2008/0314923 | A1 | 12/2008 | Faller et al. | |
| 2013/0062366 | A1 * | 3/2013 | Tansey | G06Q 30/0269 222/102 |
| 2014/0008390 | A1 * | 1/2014 | Burke | B67D 7/0216 222/101 |
| 2015/0273844 | A1 * | 10/2015 | Takagiwa | B41J 2/17513 347/86 |
| 2017/0087856 | A1 * | 3/2017 | Takagiwa | B41J 2/1752 |
| 2019/0031482 | A1 * | 1/2019 | Barron | B67D 3/0029 |

* cited by examiner

CASSETTE HAVING A PRESS ROLLER

BACKGROUND OF THE INVENTION

The present invention relates to a cassette consisting of two mutually connectable cassette trays, between which a tubular bag to be emptied, having an outlet opening, is suspendingly held and is emptiable in a largely residue-free manner by means of a press roller.

Cassettes of the type which is here of interest are suitable for those dispensers in which one or more cassettes are insertable and, if need be, heatable. In particular, dispensers for flowable foods which must be delivered in a metered manner are here at issue. Such dispensers are used, in particular, in snackbars and fastfood restaurants.

From US2002/0092879, a dispenser device for the food supply sector is already known, in which a tubular bag having a viscous content is fitted or fittable and has an auxiliary device with which, by mechanical application of pressure onto the tubular bag, the viscous content present in the tubular bag is continuously shovable in the direction of the dispensing device on the tubular bag. In particular, there is here disclosed a press roller which, in the fluid dispenser, rests on and bears horizontally against the tubular bag and, by its own weight, is capable of shoving the viscous content present in the tubular bag continuously to the dispensing device on the tubular bag. This dispenser device has, however, no cassettes, and the tubular bag is not suspended, but rather is held clampingly on the frontal cover of the dispenser housing. The press roller possesses a core which is rotatably mounted on an axle and onto which is slipped a hollow-cylindrical casing made of foamed, elastically compressible plastic. On the side walls of the dispenser housing are arranged two toothed racks, which in an arc approach the front wall and then lead downward parallel thereto. At the end of the axle which passes through the core are on both sides pivot arms with guide rollers which bear on the bottom side directly, or indirectly via a slide block. The mobility of the press roller perpendicular to the toothed rack is hence prevented.

From U.S. Pat. No. 5,199,610, a dispenser device for a toothpaste tube is disclosed. This device also has no cassettes. The device possesses a press roller which is guided on one side on a toothed rack and on the other side in a slotted guide. The press roller is moved mechanically downward via a lever system.

From U.S. Pat. No. 7,147,134 and further documents, dispensers are known which have cassettes and in which are held tubular bags which, by means of a pump, are emptiable in desired metering quantities. Such cassettes have, however, no press rollers. The problem consists, however, in the fact that, during the emptying of the tubular bags, these deform and accordingly tend to form folds in which residual quantities of the useful contents remain trapped. Accordingly, losses of up to 15% are perfectly usual. Cassettes for dispenser units for receiving tubular bags which have, moreover, a press roller are hitherto unknown. Only such cassettes which are made of metal or plastic make it possible to ensure a continuous operation where the corresponding dispenser possesses more than one cassette, so that, during the replacement of a cassette by a new cassette with filled tubular bag, metering can continue to be performed without interruption. An operating stoppage is hereby avoided.

SUMMARY OF THE INVENTION

The object of the present invention is consequently to provide a cassette of the type stated in the introduction with a press roller which is capable of largely avoiding the creasing in the tubular bag and ensures an absolutely horizontal orientation of the press roller in any emptying position, and the function of which, even with the formation of folds in the tubular bag or in case of somewhat larger soft parts in the bag content, can be overcome without stoppage of the press roller, which moves downward solely under the force of its weight. As already known from US2002/0092879A1, the press roller possesses a cylindrical, metal core having a thereon fitted hollow-cylindrical casing, made of foamed, elastically compressible plastic, wherein the core is provided with respectively a rotationally fixedly mounted gearwheel, wherein, in accordance with the size of the cassette, two parallel toothed racks aligned with and matched to the gearwheels are present.

The present invention now for the first time provides a solution for cassettes for a metering device, as here described, which is distinguished by the fact that the two gearwheels arranged in a rotationally fixed manner on the core of the press roller are each provided with a thereon disposed, freely rotating running wheel, which running wheels have a larger diameter than the gearwheels, and that, in the cassette tray which in the closed state lies opposite the cassette tray with the toothed racks, tracks are present, on which the freely rotating running wheel can roll.

Further advantageous embodiments of the subject of the invention emerge from the dependent claims and the significance and impact of which are explained in the following description.

BRIEF DESCRIPTION OF THE DRAWINGS

In the attached drawing, a preferred illustrative embodiment of the subject of the invention is represented and described below, wherein.

DETAILED DESCRIPTION

Figure 1:
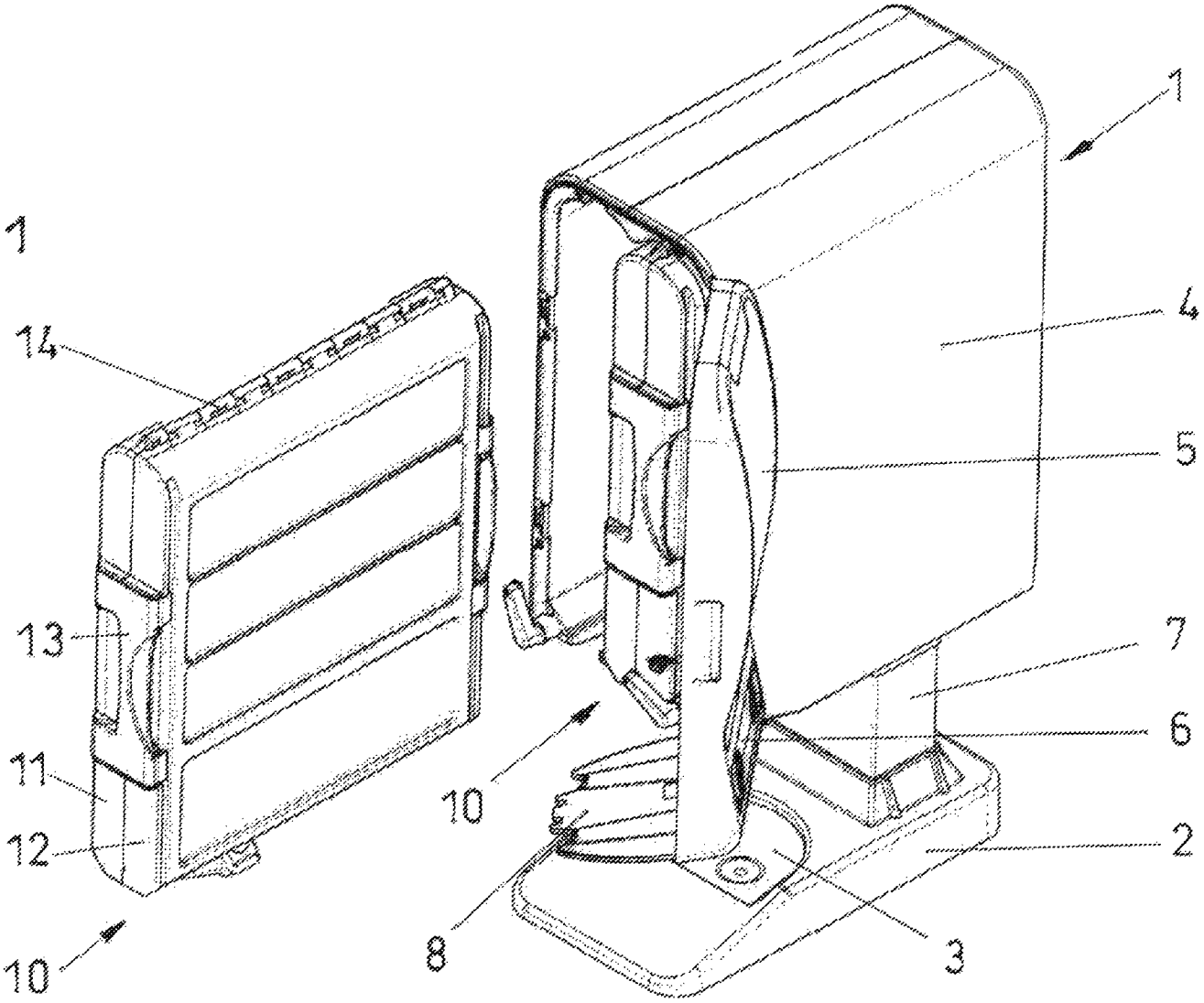
FIG. 1 shows an example of a dispenser device with two therein insertable and exchangeable cassettes, in perspective view.

In FIG. 1, an illustrative embodiment of a metering device, which is denoted in its entirety by 1, is shown in perspective view. The metering device 1 possesses a pedestal 2, in which is molded a collecting tray 3. The housing 4 of the metering device 1 is connected to the pedestal 2 by means of a column 7. The housing 4 serves to receive one or more cassettes 10, which are exchangeably insertable into the housing. The housing 4 of the metering device 1 is able to be closed by means of a front cover 5. In the front cover 5 is arranged a display 6 with corresponding control panel. Via the control panel, the desired metering quantity is able to be set, and then a metering portion triggered via a corresponding control button.

Figure 2:
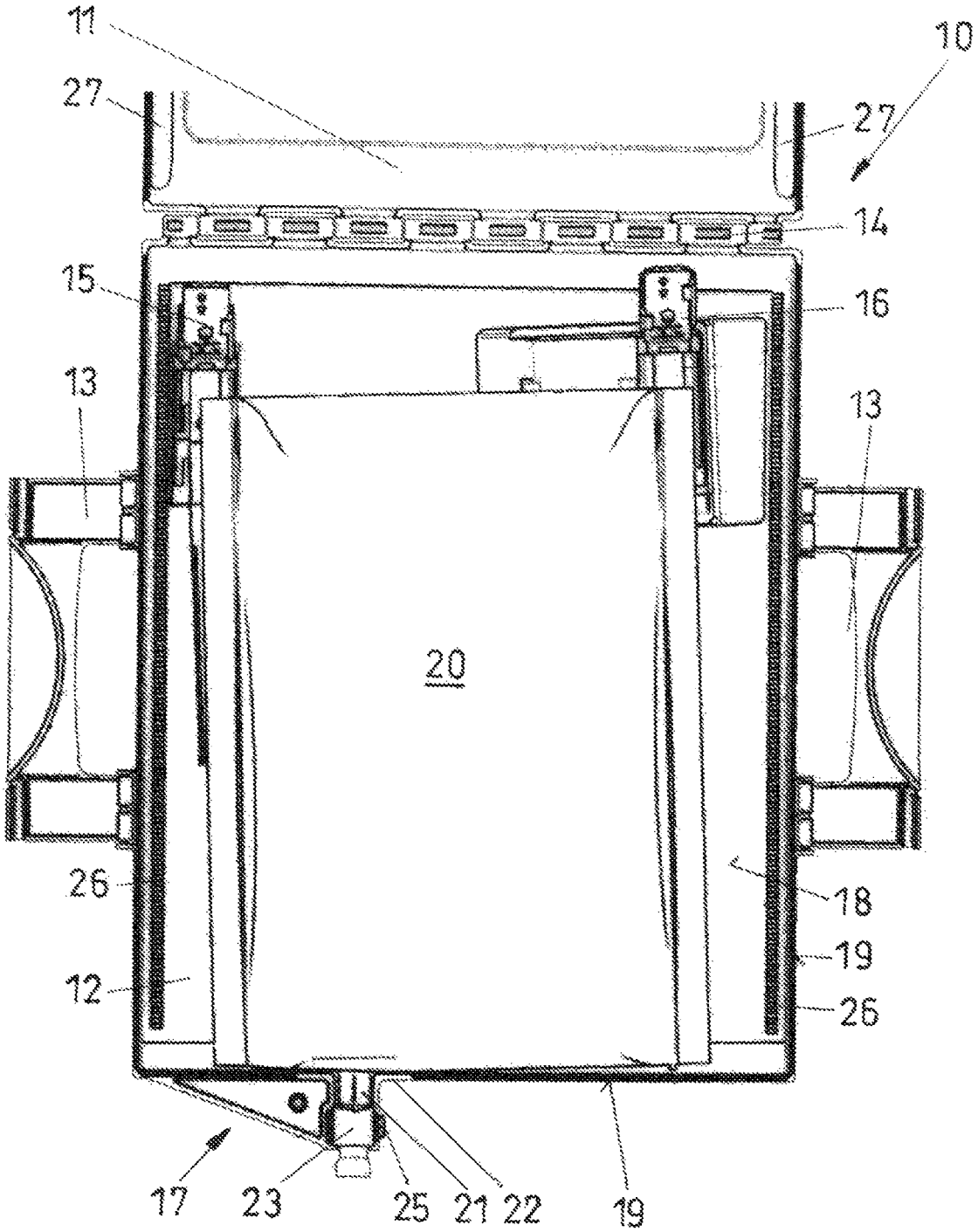
FIG. 2 shows a cassette according to FIG. 1 in the opened state in a partial view, with tubular bag inserted therein.

In FIG. 2, a cassette according to the invention is shown in the opened state, with a tubular bag 20 suspendingly held therein. This tubular bag 20 lies in a cassette tray 12, which is also referred to below as the base cassette tray. The other cassette tray 11 is correspondingly referred to as the cover cassette tray. The base cassette tray 12 is connected to the cover cassette tray 11 via a hinged connecting joint. Of course, the two cassette trays do not necessarily need to be connected to each other via a hinged connecting joint, but rather the two cassette trays 11, 12 can also be plugged together and then be secured in this closed position by means of closure means 13. In the present case, these closure means 13 are hook-shaped handles, which are articulately arranged on the base cassette tray 12 and, in the closed state of the cassette 10, at least partially overlap the cover cassette tray 11 and hook elastically in place.

The tubular bag 20 is held in the base cassette tray 12 by means of two clamps 15, 16. The clamp 15 is fixedly arranged, while the clamp 16 is designed to be displaceable. As a result, tubular bags 20 of different size are able to be held. Moreover, the tubular bag 20 is held slightly inclined in the cassette, which is conducive to an emptying which is as loss-free as possible.

On the tubular bag 20, an outflow nozzle 21 is fixedly connected by means of a flange 22. Connected to the outflow nozzle 21 is arranged a pump 23. Molded onto the base cassette tray 12 is a pump mounting 24, in which the pump 23 is held by form closure and/or force closure. The pump possesses a plug-in drive shaft receptacle 25, in which the drive shaft, in the inserted state of the cassette 10 in the dispenser device, engages.

The cassette 10 is preferably made of plastic. The two cassette trays 11 and 12 can be produced separately, or, where the hinged connecting joint 14 is designed as a film hinge, the two cassette trays 11, 12 can be produced in one piece. The actual drive of the pump is part of the dispenser device, yet cannot be seen in FIG. 1. The front cover 5 possesses on its lower end a molded-on insertion safeguard 8. This presses against the pump mounting 24 and ensures that the inserted cassettes 10 are in the correct position in the housing 4 as soon as the front cover 5 is closed. It is here also ensured that the non-visible drive shaft is correctly connected to the plug-in drive shaft receptacle 25 of the pump 23.

Figure 4:
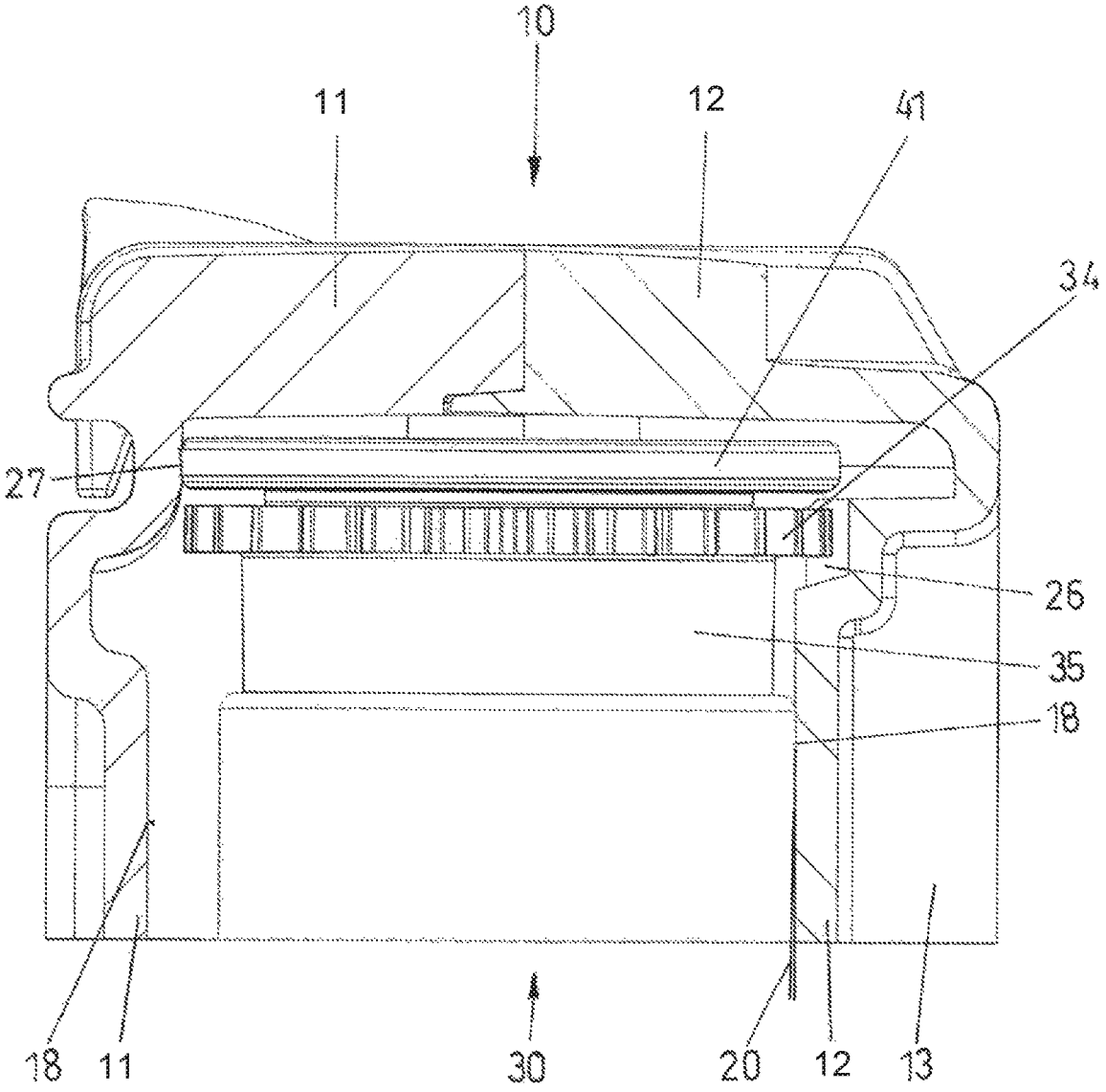
FIG. 4 shows a partial section through the closed cassette in order to illustrate the guidance of the press roller in the cassette.

Each cassette tray 11, 12 respectively possesses a tray face wall 18, which is bounded by a circumferential side wall 19. Molded integrally on or in the tray face wall 18 are toothed racks 26. The toothed racks run in parallel and each in relative proximity to the longitudinal side walls, which are part of the circumferential side wall 19. Depending on the design, the two parallel toothed racks 26 can be molded as depressions in the tray face wall 18, preferably in the base cassette shell 12. This is shown by an enlarged partial section through the closed cassette 10 in FIG. 4. The cover cassette tray 11 accordingly possesses two parallel tracks 27, each running directly adjacent to the longitudinal side walls of the circumferential side wall 19. These tracks 27 are elevated in relation to the tray face wall 18 on the inner side of the cassette. The significance and effect thereof is examined in greater detail later.

Figure 3:
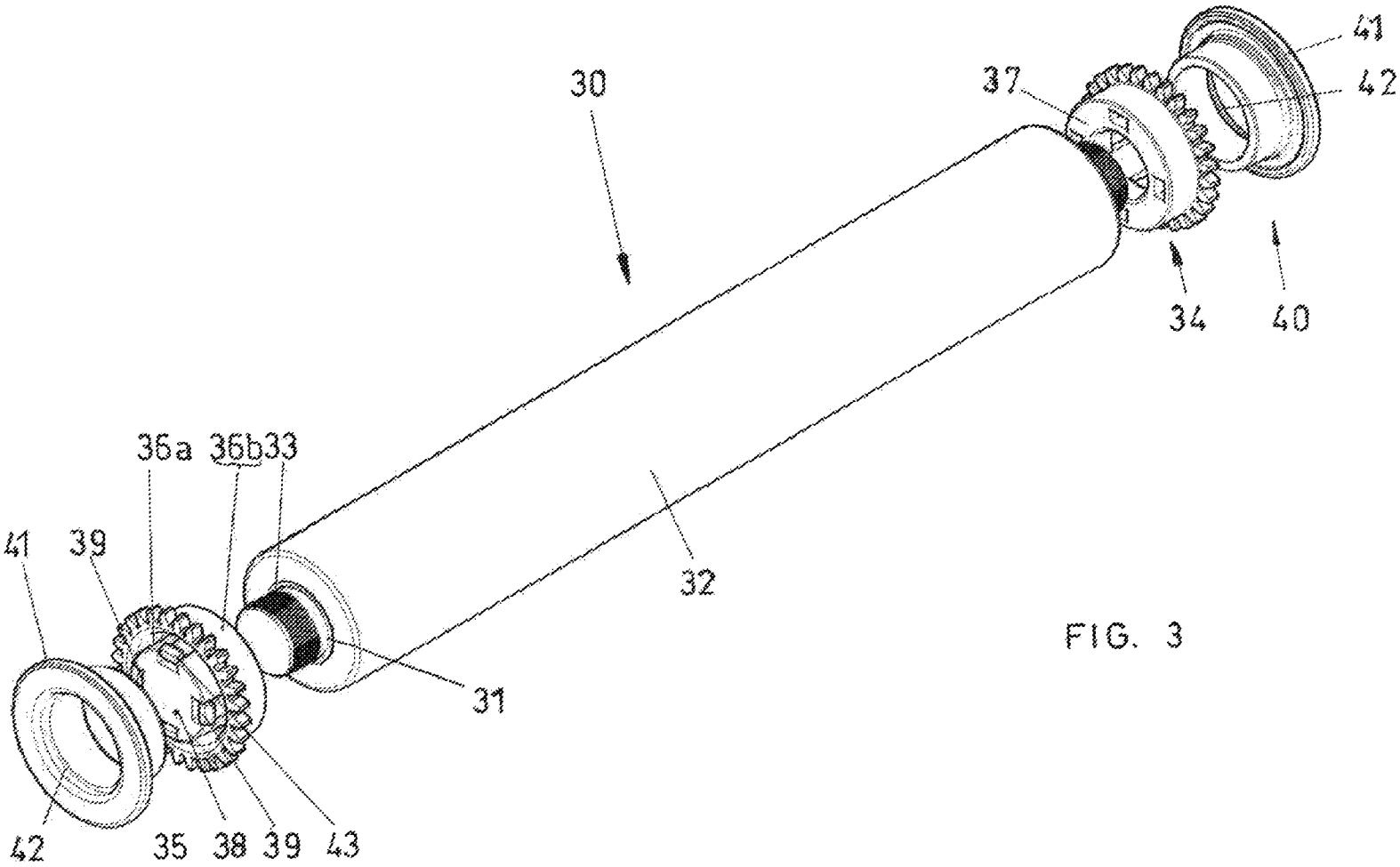
FIG. 3 shows the press roller in a perspective partial view, wherein the gearwheel, which is mountable onto the core, and the running wheel to be connected thereto, is represented in an exploded drawing.

In FIG. 3, the press roller 30 is represented in detail in an exploded drawing. The press roller 30 has a cylindrical core made of metal, for instance of steel, brass, bronze or iron. Onto the cylindrical core 31 is fitted a hollow-cylindrical casing made of foamed, elastically compressible plastic. Such a casing can consist, for example, of a foamed polyurethane. The hardness of the hollow-cylindrical casing is defined according to the viscosity of the material to be squeezed out of the tubular bag 20. If, for the hollow-cylindrical casing, too soft a material is chosen, then the press roller is incapable of smoothing out possibly occurring creases or folds of the tubular bag. The person skilled in the art will preferably choose a material having a Shore A hardness between 20 and 60 Shore A.

Those ends of the cylindrical core 31 which jut out from the hollow-cylindrical casing have a roughened structure 33. Onto these ends of the cylindrical core 31 is slipped a gearwheel 34. This gearwheel 34 is part of a double-walled hub 35. The double-walled hub 35 consists of two concentric pipe sections, which are connected to each other via a radially running connecting wall 37.

This radial connecting wall 37 forms, in the slipped-on state of the double-walled hub 35 onto the cylindrical core 31, a stop faces for the hollow-cylindrical casing 32. The inner concentric pipe section possesses a cover face 38, which in the slipped-on state of the double-walled hub 35 forms a stop for the cylindrical core 31. In the casing wall of the inner pipe section **36*a*, a plurality of flexible tongues 39 are fitted distributed over the periphery at a regular distance apart. Molded on in the outermost region of the outer pipe section 36*b* is the ring gear, which forms the gearwheel 34. This ring gear is matched in shape and size to the toothed rack 26**.

Since the double-walled hub 35 sits with press fit on the cylindrical core 31 of the press roller 30, the gearwheel 34 is connected in a rotationally fixed manner to the cylindrical core 31. The roughened structure 33 on the ends of the cylindrical core 31 increases the adhesion of said hub on the core.

In the double-walled hub 35 is now rotatably mounted a bearing bushing 40. The bearing bushing 40 has an internal diameter which is slightly larger than the external diameter of the inner pipe section **36*a* of the double-walled hub 35. The axial length of the bearing bushing 40 is longer than the inner pipe section 36*a* of the double-walled hub 35. On the peripheral end the bearing bushing 40 possesses a flange, which forms the running wheel 41**.

In the bearing bushing 40 is molded a step-like offset 42 or an annular groove. In this annular groove or on this offset 42, flexible tongues 39 now engage once the bearing bushing 40 is slipped onto the inner pipe section **36*a*. The running wheel 41 is hence secured in the axial direction and, by virtue of an appropriate play, the bushing 40 is supported in a freely rotating manner in the double-walled hub. The running wheel 41 is molded as a flange onto the end of the bearing bushing 40 and forms the freely rotating running wheel 41. The flexible tongues 39 have in the region of their freely flexible ends appropriate retaining bosses 43, which engage either in the respective annular groove 42 or behind the step-like offset in the bearing bushing 40**.

In the use of the cassette according to the invention, this is initially opened into the position shown by FIG. 2, and the tubular bag 20 is inserted held tight by means of the clamps 15 and 16, and the pump 23 is slipped into the pump mounting 24. Now the press roller 30 is inserted, directly beneath the clamps 15 and 16 with the gearwheels 34 into the toothed racks 26. The press roller 30 now rests in the uppermost region on the tubular bag, and the two cassette trays 11, 12 are now snapped shut in the direction of closing and, by means of the closure means 13, the cassette is closed off. As is clearly apparent in FIG. 4, the tubular bag 20 now rests on the tray face wall 18. The press roller 30 is herein arranged such that the hollow-cylindrical casing 32 made of a resiliently elastic plastic would rest directly on the corresponding tray base wall 18 if in the cassette there were no tubular bag. This, depending on the hardness of the hollow-cylindrical casing 32, must not, or only slightly, deform. If the tubular bag 20, however, is lying in the cassette 10, then the hollow-cylindrical casing is compressed at least by the thickness of the two walls of the tubular bag. Since the press roller 30, on the one hand, rests in one cassette tray with the gearwheels 34 in the toothed racks 26 and, on the other hand, the freely rotating running wheels rest on the tracks 27 in the opposite cassette tray, the position of the press roller is always secured. If in the tubular bag 20 a fold is formed and this is not smoothed by the press roller 30, then the press roller is nevertheless capable of continuing its travel in the upright cassette further downward under the influence of gravity, wherein only the hollow-cylindrical casing 32 is compressed in correspondingly stronger measure.

Hitherto, in known cassettes of a metering device which have no press roller, a residual quantity of 5-12% of the content remained in the emptied tubular bag 20. In trials with the cassette according to the invention, the residual quantity in the emptied cassette with integrated press roller 30 was able to be reduced to 1-4% of the original content. The trials were carried out with a variety of liquids having a viscosity of 1-70,000 Centipoids. In these trials, tubular bags which had as the content foods with solid components were also used. Such foods are, for instance, sauces containing cooked vegetable particles, as are known, for instance, as tartar sauce or barbecue sauce. Precisely sauces of this kind, as a result of their nonexistent homogeneity, produce increased creasing tendency of the tubular bags, so that entrapments are increasingly formed.

In addition to the embodiment which is described here in detail, deviations of the design within the scope of this protective right are perfectly possible. For instance, the running surfaces can be formed as recessed channels, in which the correspondingly designed running wheels travel. In this case, the tracks would then be designed as conical grooves, and the running wheels shaped accordingly. In such an embodiment, it is virtually impossible to place the press roller in such a way on the toothed racks that the left side, in comparison to the right side, is also only offset by one tooth, since now the running wheels jam in the groove-shaped tracks.

In the here represented embodiment, the pump 23 is constituted by a plastics-made gear pump or vane pump, though other pumps, of course, can also be considered. In particular, the pump should also in no way be a pump which is electromagnetically driven, but rather the pump can also, for instance, be manually actuable via an actuating lever. Such an embodiment then makes do, of course, without external energy.

The big advantage of this solution according to the invention consists in the fact that it is here virtually impossible for any air pockets to be able to make their way into the tubular bag while the tubular bag is emptied. In particular in the here represented embodiment, in which the tubular bag is already provided with a molded-on outflow nozzle, and this outflow nozzle is at the same time jointly supplied with a plastics disposable pump. In this way, it is virtually also impossible to contaminate the content, as can otherwise happen if a tubular bag is pierced. Moreover, such a disposable pump has an integral elastomer valve, which automatically closes off the outlet of the pump after each metering.

The here described cassette according to the invention is able to be produced virtually with all necessary structural elements, from one or two parts, by injection molding. Only the clamps have still to be used for the securement of the tubular bag. Also, the fitting of the press roller is extremely simple, in which the hollow-cylindrical casing has merely to be slipped onto the cylindrical core 31, and afterward, on both sides, a double-walled hub can respectively be mounted, and into this can then be placed the bearing bushing with the molded-on running wheels.

By virtue of the exact guidance of the press roller 30, which, on the one hand, runs with the gearwheels 34 on the toothed racks 26 and, on the other hand, with the running wheels 41 on the running surfaces, wherein the gearwheels and the press roller rotate in one direction, and the running wheels in the opposite direction. By virtue of this design, a low-friction, but exact, tilt-free running of the press roller is guaranteed.

It is of advantage, however, if the maximinal nominal measure between the running surface 27 and the tooth gullet of the toothed rack 26, on the same side of the closed cassette 10, is designed larger than the minimal nominal measure. This allows a certain amount of deflection without the engagement of the press roller on the toothed racks being jeopardized. If, however, somewhat larger portions of solids are present in the content of the tubular bag 20 and the tubular bag here also happens to form a fold, then the rolling down of the press roller is still ensured merely under the effect of its own weight.

REFERENCE SYMBOL LIST

1. metering device
2. pedestal
3. collecting tray
4. housing
5. front cover
6. display and control panel
7. column
8. insertion safeguard
10. cassette
11. cassette tray, cover cassette tray
12. cassette tray, base cassette tray
13. closure means
14. hinged connecting joint of the two cassette trays
15. clamp, fixedly arranged
16. clamp, displaceably arranged
17. pump mounting
18. bottom face wall
19. circumferential side wall
20. tubular bag
21. outflow nozzle
22. flange
23. pump
24. bearing mounting
25. plug-in drive shaft receptacle
26. toothed racks
27. track
30. press roller
31. cylindrical core
32. hollow-cylindrical casing
33. roughened structure
34. gearwheel
35. double-walled hub
**36*a* concentric pipe sections of the hub 35**
**36*b* concentric pipe sections of the hub 35**
37. radial connecting wall
38. cover surface
39. flexible tongues
40. bearing bushing
41. running wheel, flange of the bearing bushing
42. annular groove of the step-like offset
43. retaining bosses of the flexible tongues 39

The invention claimed is:

1. A cassette (10) comprising first and second mutually connectable cassette trays (11, 12), between which a tubular bag (20) to be emptied is suspendingly held and is emptiable in a largely residue-free manner by means of a press roller (30), wherein the tubular bag has an outlet opening, wherein the press roller (30) includes a cylindrical metal core (31) having mounted thereon a hollow-cylindrical casing (32) made of foamed, elastically compressible plastic, and wherein the core (31) is on both sides provided with respective rotationally fixedly mounted gearwheels (34), and wherein in the second cassette tray (12), on an inner side thereof, are arranged two parallel toothed racks (26) aligned with and matched to the gearwheels (34), characterized in that the gearwheels (34) have thereon respective freely rotating running wheels (41), which running wheels each have a larger diameter than the gearwheels, and wherein the first cassette tray (11), which in the closed state lies opposite the second cassette tray (12), has therein tracks (27) for the running wheels (41).

2. The cassette as claimed in claim 1, characterized in that each of the running wheels (41) has a running surface which overtops the teeth of a corresponding one of the gearwheels (34).

3. The cassette as claimed in claim 1, characterized in that each of the gearwheels (34) is part of a double-walled hub (35) including inner and outer concentric pipe sections (36*a*, 36*b*) which are fixedly connected to each other via a radially running connecting wall (37), wherein the inner pipe section (36*a*) has an internal diameter which is matched to a diameter of the core (31) of the press roller (30) such that the core (31) of the press roller (30) fits with press fit into the inner pipe section (36*a*) of the double-walled hub, while a ring gear, which forms a corresponding one of the gearwheels (34), is molded onto the outer pipe section of the double-walled hub (35).

4. The cassette as claimed in claim 3, characterized in that the inner pipe section (36*a*) of the double-walled hub (35) has an end wall which at least partially covers the inner pipe section and which forms a cover surface (38) which, in a direction of mounting, forms a stop for the core (31).

5. The cassette as claimed in claim 3, characterized in that the inner pipe section (36*a*) is longer than the outer pipe section (36*b*).

6. The cassette as claimed in claim 3, characterized in that the inner pipe section (36*a*) of the double-walled hub (35) has a plurality of radially outwardly springing tongues (39), wherein each of the tongues (39) has a radially outwardly directed retaining boss (43).

7. The cassette as claimed in claim 4, characterized in that the running wheels (41) each include a tubular bearing bushing (40), onto an end of which a corresponding one of the running wheels (41) is integrally molded as a flange, wherein an internal diameter of the bearing bushing is matched to an external diameter of the inner pipe section (36*a*) of the double-walled hub (35) such that the bearing bushing runs rotatably on the hub.

8. The cassette as claimed in claim 6, characterized in that the bearing bushing (40) has an annular groove or a step-like offset (42), in which the flexible tongues (39) engage.

9. The cassette as claimed in claim 1, characterized in that the cassette trays (11, 12) are made of plastic and the toothed racks (26) are integrally molded onto the second cassette tray (12).

10. The cassette as claimed in claim 9, characterized in that tracks (27l) are integrally molded in the first cassette tray (11).

11. The cassette as claimed in claim 10, characterized in that the tracks (27) are shaped as flange grooves, in which the running wheels (41) travel.

12. The cassette as claimed in claim 1, characterized in that the first and second cassette trays (11, 12) are articulately connected to each other via a hinged connecting joint (14).

13. The cassette as claimed in claim 12, characterized in that the first and second cassette trays (11, 12) are connected to each other via a film hinge.

14. The cassette as claimed in claim 10, characterized in that the first and second cassette trays (11, 12) each have a bottom face wall (18) and a circumferential side wall (19), and wherein the toothed racks (26) and/or the tracks (27) are shaped as corresponding thickenings or thinnings of the bottom face wall (18).

15. The cassette (10) as claimed in claim 10, characterized in that a minimum nominal measure between one of the tracks (27) and a tooth root of a toothed rack (26) on the same side of the closed cassette (10) maximally exceeds by half a height of a tooth of the toothed rack.

* * * * *